US006001886A

United States Patent [19]

Shirodkar

[11] Patent Number: 6,001,886

[45] **Date of Patent: *Dec. 14, 1999**

[54] PROCESS FOR STABLE AQUEOUS ASPHALT EMULSIONS

[75] Inventor: Shailaja Madhusudhan Shirodkar, Wappingers Falls, N.Y.

[73] Assignee: Texaco Inc., White Plains, N.Y.

[ * ] Notice: This patent is subject to a terminal disclaimer.

[21] Appl. No.: 09/170,484

[22] Filed: Oct. 13, 1998

Related U.S. Application Data

[63] Continuation of application No. 08/625,387, Apr. 1, 1996, Pat. No. 5,856,680.

[51] Int. Cl.[6] ..... B01J 13/00; C10L 1/32

[52] U.S. Cl. ..... 516/51; 44/301; 516/928

[58] Field of Search ..... 106/277; 516/51, 516/928; 44/301

[56] References Cited

U.S. PATENT DOCUMENTS

| | | | |
|---|---|---|---|
| Re. 16,328 | 4/1926 | Kirschbraun | 252/311.5 |
| 2,232,977 | 2/1941 | Schuh | 252/311.5 |
| 2,481,374 | 9/1949 | Watts et al. | 252/311.5 |
| 2,782,169 | 2/1957 | Brown et al. | 252/311.5 |
| 2,993,002 | 7/1961 | Wright et al. | 252/311.5 |
| 3,276,887 | 10/1966 | Pitchford | 106/277 |
| 3,432,320 | 3/1969 | Pitchford | 106/277 |
| 3,808,020 | 4/1974 | Pitchford | 106/277 |
| 4,610,695 | 9/1986 | Crespin et al. | 252/311.5 X |
| 4,757,833 | 7/1988 | Danley | 44/301 X |
| 5,480,583 | 1/1996 | Rivas et al. | 252/311.5 |
| 5,856,680 | 1/1999 | Shirodkar | 252/314 |

*Primary Examiner*—Richard D. Lovering
*Attorney, Agent, or Firm*—Henry H. Gibson; Rodman & Rodman

[57] ABSTRACT

A petroleum derived oil is subjected to crude oil distillation or propane deasphalting to yield a viscous asphalt residue. The viscous asphalt residue is combined with an aqueous emulsifier comprising an EO-PO-EO block copolymer and passed through a mixer at 60° C. to 70° C. to form an emulsion. Criticality has been found in the amount of propylene oxide in the block copolymer and in the asphalt particle size. These emulsions are stable and can be transported by pumping through a pipeline. They are used as boiler fuel. They are also gasified with insufficient oxygen to produce synthesis gas.

25 Claims, No Drawings

PROCESS FOR STABLE AQUEOUS ASPHALT EMULSIONS

This application is a continuation of application Ser. No. 08/625,387 filed Apr. 1, 1996, now U.S. Pat. No. 5,856,680.

BACKGROUND OF THE INVENTION

1. Field of the Invention

The invention is a process for producing stable asphalt emulsions. The emulsions comprise asphalt particles, water and an ethylene oxide/propylene oxide/ethylene oxide block copolymer emulsifying agent.

2. Description of Related Methods in the Field

Crude petroleum is refined to produce fuel and lubricating products. Petroleum may be supplemented with much lesser amounts of other crude oils from bituminous sand and shale. These crude oils require greater or lesser amounts of refining to convert them to products. Their individual properties are determined by the sum of the components.

Crude oils with greater amounts of asphalt, metals, organic sulfur and organic nitrogen require additional processing to remove them. Asphalt is a mixture of asphaltene and maltene. Of these constituents, asphalt is removed relatively earlier in the refining process because it interferes with processes such as hydrotreating to remove organic sulfur and nitrogen. In particular, asphalt produces amounts of coke which deactivates hydrotreating catalyst. It also forms precipitates and contains precipitate precursors which hinder subsequent processing.

In the past, asphalt and heavier components of crude oil were either used in road paving or added to bunker fuels and combusted. Recently, because of the Clean Air Act, the emission regulations have become more stringent in $NO_x$ and sulfur emissions therefore, creating a need to use up asphalt by other means.

U.S. Pat. No. 5,000,757 to S. J. Puttock et al. discloses the preparation and combustion of fuel oil emulsions.

U.S. Pat. No. 5,089,052 to A. C. Ludwig discloses the emulsification of rock asphalt. The emulsions are formulated to be effective as binders for limestone aggregate coatings, seals, coats, pliable mats and other applications.

U.S. Pat. No. 4,776,977 to S. E. Taylor discloses emulsions of oil in water. These emulsions are noted for the relatively high proportion of discontinuous phase. The emulsions are suitable for pipeline transportation.

U.S. Pat. No. 4,978,365 to A. A. Gregoli et al. discloses the preparation of crude oil emulsions for pipeline transmission. The emulsifying agent is an ethoxylated alkylphenol. Linear alkyl moieties may be attached to the alkylphenol.

There is a need in the art for a commercial process which uses solid asphalt from crude oil refining and from solvent deasphalting processes.

SUMMARY OF THE INVENTION

The invention is a process for forming stable aqueous asphalt emulsions.

A petroleum derived oil is deasphalted by extraction with a deasphalting solvent to yield as the insoluble phase, an asphalt residue.

Water and 0.001 wt % to 10 wt % of a triblock copolymer are admixed to form an emulsifier. The copolymer is of the formula:

$$HO—(CH_2CH_2O)_x—(CH_2CH(CH_3)O)_y—(CH_2CH_2O)_z—H$$

wherein: x ranges from 5 to 45,
y ranges from 25 to 60,
z ranges from 5 to 45, and
wherein: the molecular weight of the copolymer ranges from 1500 to 10,000 g/mole.

The emulsifier is admixed with 60 wt % to 80 wt % of the asphalt residue to form an admixture.

The admixture is subjected to size reduction at a temperature of 50° C. to 100° C. to reduce the asphalt residue contained therein to asphalt particles having an average particle diameter of 30 microns or less. This results in an aqueous asphalt emulsion.

The aqueous asphalt emulsions are transportable by pumping through a pipeline to point of use. The emulsions are used for their caloric content as boiler fuel to produce steam. In the alternative, the suspensions are used for their hydrocarbon and water content as partial oxidation process feedstock to make syngas.

DETAILED DESCRIPTION OF THE INVENTION

The invention is a process for commercially using an asphalt residue. Asphalt is the heaviest fraction from crude petroleum and comprises asphaltene and maltene. Asphalt residue is defined analytically as the insoluble fraction which remains after 1 gram of a hydrocarbon oil, such as a petroleum derived oil, is extracted with 40 milliliters of heptane.

Asphalt is found predominantly in petroleum fractions with other hydrocarbons of similar molecular weight and boiling range. Generally, a crude petroleum is fractionated to remove liquid fuel and lighter fractions such as light gas oil, gasoline, diesel oil and kerosene collectively having a boiling range of 360° F. to about 650° F. Gas oil and vacuum gas oil fractions are removed by atmospheric and vacuum distillation. These fractions have a boiling range of about 600° F. to about 900° F. The petroleum vacuum residuum has an initial boiling point of approximately 900° F. and boils over a range exceeding 1100° F. Petroleum vacuum residuum is the primary source of asphalt of the invention.

Petroleum vacuum residuum can be further subjected to a solvent deasphalting process such as the commercially available ROSE® process (Residual Oil Solvent Extraction) to precipitate the asphaltic residue and separate any light fraction. In the process, the vacuum residuum is subjected to counter-current contacting at solvent deasphalting conditions, generally at a temperature in the range of 50° F. to 400° F., preferably 150° F. to 300° F., a dosage of from 0.5 to 10, preferably 1.0 to 3.0 vol. solvent/vol. oil and a pressure of atmospheric pressure to 400 psig, preferably atmospheric pressure to 50 psig. The actual deasphalting conditions chosen are dependent on the solvent. That is, the temperature chosen should not exceed the critical temperature of the solvent and the pressure is maintained above the autogenous pressure to prevent vaporization.

Deasphalted oil and solvent are removed by distillation by stripping the asphalt layer leaving behind a viscous asphaltic residue. Deasphalting solvents which are useful for this purpose include $C_2$ to $C_8$ paraffins, furfural and N-methyl-2-pyrrolidone. Propane and butane are preferred.

Propane as a solvent results in the lowest yield of deasphalted oil and highest yield of asphaltic residue. Because propane is the preferred commercial solvent, the process is often referred to as propane deasphalting.

Iso-butane and n-butane are also used commercially. Butane solvents result in higher yield of the deasphalted oil and lower yield of asphaltic material. Because the resulting asphaltic residue does not have a commercially advantageous use, lesser amounts of this material are usually preferred in commercial production as in the butane deasphalting process.

Propane or butane deasphalting produces asphaltic residues which are solid at atmospheric temperatures. The softening point is 100° F. to 200° F., preferably 100° F. to 150° F., most preferably 100° F. to 120° F. as measured by the Ring and Ball method (ASTM D-36). Higher molecular weight deasphalting solvents produce asphaltic residues displaying a higher softening point. They have a hardness of 100 to 250 penetration according to AASHTO T-49. These asphaltic residues are typically used for road paving. They can in the alternative be subjected to hydrocracking in an ebullated bed process. This disposition is less useful because of high sulfur, nitrogen and ash residue and because of insolubility with other hydrocarbon oils. These processes of vacuum distillation and deasphalting can be effective for producing the asphaltic residue of the invention.

The emulsifier used in the invention comprises water, a specific triblock copolymer and optionally a surfactant. The copolymer has the general formula:

$$HO—(CH_2CH_2O)_x—(CH_2CH(CH_3)O)_y—(CH_2CH_2O)_z—H$$

wherein: x ranges from 5 to 45,
y ranges from 25 to 60,
z ranges from 5 to 45, and
wherein: the molecular weight of the copolymer ranges from 1500 to 10,000.

These copolymers are available commercially. It is shown in the Example that the molecular weight of the propoxy moiety in the copolymer is critical to forming stable emulsions with asphalt residue. Stable emulsions are formed when y ranges from 25 to 60, providing a propoxy molecular weight of 1450 to 3480. Preferably y ranges from 30 to 55, providing a propoxy molecular weight of 1740 to 3190. Most preferably y ranges from 34 to 52, providing a propoxy molecular weight of 1972 to 3016.

The molecular weight of the two ethoxy moieties is not critical. However, position of ethoxy moieties in the block copolymer chain were found to be critical. Stable asphalt emulsions could not be formed unless the propoxy moiety was capped at both ends with ethoxy moieties. Copolymers with a terminal propoxy moieties and a center ethoxy moeity did not form stable emulsions.

The block copolymer has a molecular weight of 1500 to 10,000; preferably 1500 to 7000; most preferably 1500 to 6000.

The mechanism of the invention is not known with absolute certainty. The invention was discovered by experimentation. Inventor theorizes that the identified molecular weight range for the propoxy moiety is the most effective size for coating asphalt particles of 30 micron or less diameter.

Inventor theorizes that gravitational forces on a 30 micron or smaller particle can be overcome by coating with the block copolymer. An oil soluble propoxy moiety physically attaches to and coats an asphalt particle. The water soluble ethoxy moiety ionically attaches to surrounding water molecules through the terminal hydroxy groups.

The resulting emulsion is stable. Combinations outside the inventive range were not so stable. That is, larger asphalt particle sizes, larger or smaller propoxy moieties, and absence of ethoxy capping all failed to produce stable emulsions in the laboratory.

The emulsifier is made up by first heating water to a temperature of up to but not exceeding 100° C., preferably 60° C. to 70° C. Copolymer is admixed in an amount of 0.001 wt % to 10 wt %, preferably oil wt % to 5 wt %. The copolymer is completely soluble in these amounts.

Optionally, surface active agents can be added to the emulsifier to improve the physical properties of the emulsion. Surface active agents include cationic, anionic and nonionic surfactants.

Cationic surfactants include quaternary ammonium salts, n-alkyl diamines, n-alkyl triamines, salts of fatty amines, amido amines and mixtures thereof.

Anionic surfactants include soap and the sodium salts or organic sulfonates and sulfates. Examples include alkyl, aryl and alkylaryl sulfates and sulfonates. Also included are fatty alcohols. Examples include dodecylbenzene sulfonate, sodium lauryl sulfonate and lignin sulfonate.

Nonionic surfactants include ethoxylated alkyl phenols, ethoxylated secondary alcohols, ethoxylated amines, ethoxylated sorbitan esters and mixtures thereof.

The amount of surface active agent added is determined by the properties required. Generally the sum of the copolymer and surfactant in the emulsifier comprises 0.001 wt % to 10 wt %, preferably 0.1 wt % to 5 wt %.

Next the asphalt is heated separately to a temperature of 100° C. to 150° C. Heated asphalt and aqueous emulsifier are combined and passed to a homomixer or colloid mill. In the colloid mill the mixture is subjected to high shearing. The shearing is carried out to reduce the asphalt to particles of 30 microns or less, typically 5 microns to 30 microns, preferably 10 micron to 20 microns.

During size reduction, the steric repulsion provided by the copolymer and charge repulsion provided by anionic or cationic surface active agent present prevent the asphalt particles from coalescing. It is important not to exceed 100° C., preferably 95° C. to prevent dehydration of the resulting emulsion. If necessary, the resulting emulsion is passed through a heat exchanger to correct temperature.

Alternative size reduction methods can be used such as by means of hammer mill, roller mill, jaw crusher, grinding, cryogenic grinding and the like. The use of a colloid mill is preferred because it is best suited to a continuous process and the required temperature is maintained.

The resulting emulsion is stable and can be transported through a pipeline by pumping.

This invention is shown by way of Example.

EXAMPLE

Properties of ethoxy-propoxy-ethoxy block copolymers

| | Polymer MW* | Propoxy MW* |
|---|---|---|
| PLURONIC ® L35 | 1900 | 950 |
| PLURONIC ® L43 | 1850 | 1290 |
| PLURONIC ® L44 | 2200 | 1290 |
| PLURONIC ® P85 | 4600 | 2260 |
| PLURONIC ® P103 | 4950 | 3340 |
| PLURONIC ® P105 | 6500 | 3340 |
| PLURONIC ® P123 | 5750 | 4020 |

*MW - Molecular Weight, g/mole

These copolymers are available from BASF Aktiengesellschaft, Federal Republic of Germany.

Properties of Hydrocorbons

| | Pembroke Refinery Vacuum Residues | Arabian Medium Heavy |
|---|---|---|
| Flash Point, ° F. | 473 | 471 |
| API Gravity, ° | 7.1 | 7.1 |
| Sp. Gravity | 1.02 | 1.02 |
| Viscosity, @ 100° C., cSt | 3162 | 3154 |
| Carbon, % | 85.3 | 83.2 |
| Hydrogen, % | 9.82 | 9.74 |
| Nitrogen, % | 0.43 | 0.34 |
| Sulfur, % | 2.3 | 5.1 |

Example 1

Refinery vacuum residuum asphalt (100 g) was heated to 240° F. (115° C.) in a steel beaker. A 50:50 vol:vol mixture of PLURONIC® P103 and PLURONIC® L44 polymers was made. Polymer was added to the asphalt in an amount to comprise 4 wt % of the emulsion. Water at 212° F. (100° C.) was added so that the asphalt water was 70:30 wt %:wt % in the emulsion. The admixture was sheared in a Janke-Kunkel Ultra-Turrax T50 homomixer at 6000–7000 revolutions per minute (rpm) for one minute and then cooled to room temperature.

The viscosity measurement, particle size measurement and ASTM D-244 sieve test were carried out, three days later to measure stability of the emulsion.

Vistar and vacuum asphalt from Arabian medium petroleum were emulsified by the same procedure. Results are shown in Table 1.

Stable emulsions of the same asphalts were not formed when either PLURONIC® P103 or PLURONIC® L44 were used as the sole polymer. From this I concluded that there was a synergistic interaction between these two copolymers and asphalt particles in the emulsion. That is, these two copolymers in combination provide an average propoxy molecular weight of 2000 g/mole to 3000 g/mole per block copolymer. This average molecular weight of propoxy moiety is the best steric fit between the block copolymer and the asphalt particles.

Example 2

Refinery asphalt of Example 1 (100 g) was heated to 240° F. (115° C.) in a steel beaker. PLURONIC® P85 polymer was added to the asphalt in the amount of 4 wt % of the emulsion. Water at 212° F. (100° C.) was added so that the asphalt:water ratio was 70:30 wt %:wt % in the emulsion. The admixture was sheared in a Janke-Kunkel Ultra-Turrax T50 homomixer at 6000–7000 rpm for one minute and then cooled to room temperature. The viscosity measurement, particle size measurement and ASTM D-244 sieve test were carried out three days later to measure stability of emulsion.

By the same method vacuum asphalt from Arabian medium petroleum was emulsified. Results are shown in Table 2.

Example 3

Refinery asphalt of Example 1 (100 g) was heated to 240° F. (115° C.) in a steel beaker. A 50:50 vol:vol mixture of PLURONIC® L43 and PLURONIC® P123 was prepared. Polymer was added to the asphalt in an amount to comprise 4 wt % of the emulsion at 212° F. (100° C.) was added so that the asphalt : water ratio was 70:30 wt %:wt % in the emulsion. The admixture was sheared in a Janke-Kunkel Ultra Turrax T50 homomixer at 6000–7000 rpm for one minute and cooled to room temperature. The viscosity measurement, particle size measurement and ASTM D-244 sieve test were carried out three days later to measure stability of the emulsion.

Arabian medium heavy vacuum asphalt was emulsified by the same procedure. Results for the emulsion are shown in Table 2.

Example 4

Refinery vacuum asphalt (100 g) was heated to 240° F. (100° C.) in a steel beaker. A mixture of PLURONIC® L35 and PLURONIC® P105 was prepared in a 50:50 weight ratio. Polymer was added to the asphalt in an amount to comprise 4 wt % of the emulsion. Water at 212° F. (100° C.) was added so that the asphalt water ratio was 70:30 wt %:wt % emulsion. The admixture was sheared in a Janke-Kunkel Ultra Turrax T50 homomixer at 6000–7000 rmp for one minute and cooled to room temperature.

TABLE 1

| ASPHALT | wt %/wt % POLYMER | ASPHALT wt % | 3 DAY VISCOSITY cP | 3 DAY PARTICLE SIZE NUM./VOL. | 3 DAY SIEVE % | APPEARANCE |
|---|---|---|---|---|---|---|
| REFINERY | 2 wt %/2 wt % PLURONIC ® P103/PLURONIC ® L44 | 70.1 | 148 | 2.12/10.08 | 0.427 | SMOOTH, UNIFORM |
| VISTAR | 2 wt %/2 wt % PLURONIC ® P103/PLURONIC ® L44 | 71 | 408 | 2.41/11.48 | 0.05 | SMOOTH, UNIFORM |
| AMH VAC. | 2 wt %/2 wt % PLURONIC ® P103/PLURONIC ® L44 | 71 | 408 | 2.41/11.48 | 0.05 | SMOOTH, UNIFORM |
| AMH VAC. | 4 wt % PLURONIC ® P103 | — | — | — | — | PHASE SEPARATED |
| AMH VAC. | 4 wt % PLURONIC ® L44 | — | — | — | — | LARGE CLUMPS AT BOTTOM |

Refinery - Pembroke, Wales Refinery
Vistar - Viscous tar petroleum, flows at room temperature.
AMH. VAC. - vacuum residuum asphalt from Arabian medium heavy petroleum
3 Day Particle Size
Num. - Micron
Vol. - Micron
3 Day Sieve - ASTM D-244, %
Refinery - Pembroke, Wales Refinery The viscosity measurement, particle size measurement and ASTM D-244 sieve test were carried out three days later to measure stability of the emulsion.

Arabian medium heavy vacuum asphalt was emulsified by the same procedure. Results for the emulsion are shown in Table 2.

TABLE 2

| ASPHALT | wt %/wt % POLYMER | ASPHALT wt % | 3 DAY VISCOSITY cP | 3 DAY PARTICLE SIZE NUM./VOL. | 3 DAY SIEVE % | APPEARANCE |
|---|---|---|---|---|---|---|
| REFINERY | 4 wt % PLURONIC ® P85 | 67.9 | 267 | 2.71/21.12 | 0.141 | SMOOTH, UNIFORM |
| AMH VAC. | 4 wt % PLURONIC ® P85 | 67.7 | 901 | 3.04/18.87 | 0.223 | SMOOTH, UNIFORM |
| REFINERY | 2 wt %/2 wt % PLURONIC ® L43/PLURONIC ® P123 | 69.7 | 160 | 2.46/29.00 | 2.729 | SMOOTH, UNIFORM |
| AMH VAC. | 2 wt %/2 wt % PLURONIC ® L43/PLURONIC ® P123 | 71.2 | 160 | 2.49/25.70 | 1.024 | SMOOTH, UNIFORM |
| REFINERY | 2 wt %/2 wt % PLURONIC ® L35/PLURONIC ® P105 | 71.1 | 152 | 2.01/10.69 | 0.152 | SMOOTH, UNIFORM |
| AMH VAC. | 2 wt %/2 wt % PLURONIC ® L35/PLURONIC ® P105 | 69.1 | 158 | 1.91/8.08 | 0.052 | SMOOTH, UNIFORM |

AMH VAC. - vacuum residuum asphalt from Arabian medium heavy petroleum
Refinery - Pembroke, Wales

Example 5

Refinery asphalt of Example 1 (100 g) was heated to 240° F. (100° C.) in a steel beaker. A 50:50 wt:wt mixture of PLURONIC® P85 and nonylphenol ethoxylate N100 was prepared and added to the asphalt in an amount of 3 wt % of the emulsion. Water at 212° F. (100° C.) was added so that asphalt:water ratio in the emulsion was 70:30 wt %:wt %. The admixture was sheared in a Janke-Kunkel Ultra-Turrax T50 homomixer at 6000–7000 rpm for one minute and cooled to room temperature. The viscosity measurement, particle size measurement and ASTM D-244 sieve test were carried out three days later to measure stability of emulsion.

By the same method, vacuum asphalt from Arabian medium petroleum was emulsified. Results are shown in Table 3. These results were compared to emulsion prepared with the 100 molar ethoxylate of nonylphenol. Less copolymer were required with the triblock nonylphenol ethoxylate copolymer combination compared with the nonylphenol ethoxylate alone.

TABLE 3

| ASPHALT | wt %/wt % POLYMER | ASPHALT wt % | 3 DAY VISCOSITY cP | 3 DAY PARTICLE SIZE NUM./VOL. | 3 DAY SIEVE % | APPEARANCE |
|---|---|---|---|---|---|---|
| REFINERY | 1.5 wt %/1.5 wt % PLURONIC ® P85/ Nonylphenol ethoxylate 100 | 67.2 | 155 | 2.10/10.27 | 0.1 | SMOOTH, UNIFORM |
| AMH VAC. | 1 wt %/1 wt % PLURONIC ® P85/ Nonylphenol ethoxylate 100 | 65.8 | 129 | 2.47/16.44 | 0.1 | SMOOTH, UNIFORM |
| REFINERY | 4 wt % Nonylphenol ethoxylate 100 | 67.2 | 180 | 1.98/4.19 | 0.265 | SMOOTH, UNIFORM |
| AMH VAC. | 4 wt % Nonylphenol ethoxylate 100 | 67.7 | 151 | 1.82/5.04 | 0.262 | SMOOTH, UNIFORM |

AMH VAC. - vacuum residuum asphalt from Arabian medium heavy petroleum
Nonylphenol ethoxylate 100, 100 molar ethoxylate of nonylphenol.
Refinery - Pembroke, Wales

Example 6

The emulsion stability was tested by a simple bottle test. About 50 g of emulsion was weighed into the sample bottle and left to stand stationary for 7 days. Visual observations were made for water/asphalt phase separation. At the end of seven days, a spatula was inserted into the bottle to determine presence of a hard settlement at the bottom of the sample bottle and to observe the characteristics of the emulsion. The results of the stability test are shown in Table 4. All emulsions except for samples 2 and 6, showed excellent stability over a period of seven days. This stability was maintained for approximately a period of four weeks.

TABLE 4

| Sample | ASPHALT | wt %/wt % POLYMER | APPEARANCE |
|---|---|---|---|
| I | REFINERY | 2 wt %/2 wt % PLURONIC ® P103/PLURONIC ® L44 | SMOOTH, NO SETTLEMENT |
| II | AMH VAC. | 2 wt %/2 wt % PLURONIC ® P103/PLURONIC ® L44 | BROKE, SETTLEMENT |
| III | REFINERY. | 4 wt % PLURONIC ® P85 | SMOOTH, NO SETTLEMENT |
| IV | AMH VAC. | 4 wt % PLURONIC ® P85 | SMOOTH, NO SETTLEMENT |
| V | REFINERY. | 1.5 wt %/1.5 wt % PLURONIC ® P85/ Nonylphenol ethoxylate 100 | SMOOTH, NO SETTLEMENT |
| VI | AMH VAC. | 1.5 wt %/1.5 wt % PLURONIC ® P85/ Nonylphenol ethoxylate 100 | BROKE |
| VII | REFINERY. | 4 wt % Nonylphenol ethoxylate 100 | SMOOTH, NO SETTLEMENT |
| VIII | AMH VAC. | 4 wt % Nonylphenol ethoxylate 100 | SMOOTH, NO SETTLEMENT |

While particular embodiments of the invention have been described, it will be understood that the invention is not limited thereto since many modifications may be made, and it is, therefore, contemplated to cover by the appended claims any such modification as falls within the true spirit and scope of the invention.

The formation of petroleum residual oil emulsions is well known in the art. It is known for example that process conditions are varied along with surfactant and optionally salts. High shear equipment is used such as motionless mixers and the like.

What is claimed is:

1. A stable aqueous asphalt emulsion comprising:

a. 60 wt % to 80 wt % of asphalt residue;

b. 0.001 wt % to 10 wt % of a copolymer combination comprising a mixture of copolymers of the formula $$HO—(CH_2CH_2O)_x—(CH_2CH(CH_3)O)_y—(CH_2CH_2O)_z—H$$

wherein in said copolymer mixture:
the average of x ranges from 5 to 45,
the average of y ranges from 34 to 52,
the average of z ranges from 5 to 45, and
wherein: the average molecular weight for the copolymer mixture ranges from 1500 to 10,000; and c: water; and wherein the asphalt particles have an average particle diameter of 30 microns or less.

2. A stable aqueous asphalt emulsion of claim 1 which comprises 0.1 wt % to 5 wt % of the copolymer mixture.

3. A stable aqueous asphalt emulsion of claim 1 wherein the average asphalt particle diameter is 5 to 30 microns.

4. A stable aqueous asphalt emulsion of claim 1 wherein the average asphalt particle diameter is 10 to 20 microns.

5. A stable aqueous asphalt emulsion of claim 1 wherein the average molecular weight of the copolymer mixture is 1500 to 7000.

6. A stable aqueous asphalt emulsion of claim 1 wherein the average molecular weight for the copolymer mixture is 1500 to 6000.

7. A stable aqueous asphalt emulsion of claim 1 which comprises 0.1 wt % to 5 wt % of the copolymer mixture, and wherein the average molecular weight of the copolymer mixture is 1500 to 6000 and the average asphalt particle diameter is 5 to 30 microns.

8. A stable aqueous asphalt emulsion of claim 7 wherein the average asphalt particle diameter is 10 to 20 microns.

9. A stable aqueous asphalt emulsion of claim 1 which additionally comprises a surfactant selected from the group consisting of nonionic and anionic surfactants.

10. A stable aqueous asphalt emulsion formed by a process comprising:

a. deasphalting a petroleum oil with a deasphalting solvent to yield an asphalt residue;

b. admixing water and 0.001 wt % to 10 wt % of a copolymer combination to form an emulsifier, the copolymer combination comprising a mixture of copolymers of the formula:

$$HO—(CH_2CH_2O)_x—(CH_2CH(CH_3)O)_y—(CH_2CH_2O)_z—H$$

wherein in said mixture:
the average of x ranges from 5 to 45,
the average of y ranges from 34 to 52,
the average of z ranges from 5 to 45, and
wherein: the average molecular weight for the copolymer mixture ranges from 1500 to 10,000;

c. admixing the emulsifier with 60 wt % to 80 wt % of the asphalt residue to form an admixture; and d. subjecting the admixture to size reduction at a size reduction temperature of 50° C. to 100° C., thereby reducing the asphalt residue contained therein to asphalt particles having an average particle diameter of 30 microns or less.

11. A stable aqueous asphalt emulsion of claim 10, wherein in said process the copolymer mixture comprises 0.1 wt % to 5 wt %.

12. A stable aqueous asphalt emulsion of claim 10 wherein in said process the admixture is subjected to size reduction at a size reduction temperature of 50° C. to 95° C.

13. A stable aqueous asphalt emulsion of claim 10 wherein the average particle diameter is 5 to 30 microns.

14. A stable aqueous asphalt emulsion of claim 10 wherein the average particle diameter is 10 to 20 microns.

15. A stable aqueous asphalt emulsion of claim 10 wherein in said process the emulsifier temperature is 75° C. or less.

16. A stable aqueous asphalt emulsion of claim 10 wherein in said process the emulsifier temperature is 25° C. to 50° C.

17. A stable aqueous asphalt emulsion of claim 10 wherein in said process the average molecular weight of the copolymer mixture is 1500–7000.

18. A stable aqueous asphalt emulsion of claim 10 wherein in said process the average molecular weight of the copolymer mixture is 1500–6000.

19. A stable aqueous asphalt emulsion of claim 10 wherein in said process the emulsifier additionally comprises a surfactant selected from the group consisting of nonionic and anionic surfactants.

20. A stable aqueous asphalt emulsion of claim 10 formed by a process comprising:

a. deasphalting a petroleum oil with a deasphalting solvent to yield an asphalt residue;

b. admixing water and 0.1 wt % to 5 wt % of a copolymer combination to form an emulsifier, the copolymer combination comprising a mixture of copolymers of the formula:

$$HO—(CH_2CH_2O)_x—(CH_2CH(CH_3)O)_y—(CH_2CH_2O)_z—H$$

wherein in said mixture:
the average of x ranges from 5 to 45,
the average of y ranges from 34 to 52,
the average of z ranges from 5 to 45, and
wherein: the average molecular weight for the copolymer mixture ranges from 1500 to 6,000;

c. admixing the emulsifier with 60 wt % to 80 wt % of the asphalt residue to form an admixture; and d. subjecting the admixture to size reduction at a size reduction temperature of 50° C. to 95° C., thereby reducing the asphalt residue contained therein to asphalt particles having an average particle diameter of 5 microns to 30 microns.

21. A stable aqueous asphalt emulsion of claim 20 wherein the average particle diameter is 10 microns to 20 microns.

22. A stable aqueous asphalt emulsion of claim 20 wherein in said process the emulsifier temperature is 75° C. or less.

23. A stable aqueous asphalt emulsion formed by a process comprising:

a. deasphalting a petroleum oil with a deasphalting solvent to yield an asphalt residue;

b. admixing water and 0.1 wt % to 5 wt % of a copolymer to form an emulsifier, the copolymer being of the formula:

$$HO—(CH_2CH_2O)_x—(CH_2CH(CH_3)O)_y—(CH_2CH_2O)_z—H$$

wherein each of x and z is 5–45, y is about 39, and the molecular weight is about 4600;

c. admixing the emulsifier with 60 wt % to 80 wt % of the asphalt residue to form an admixture; and d. subjecting the admixture to size reduction at a size reduction temperature of 50° C. to 95° C., thereby reducing the asphalt residue contained therein to asphalt particles having an average particle diameter of 5 microns to 30 microns.

24. A stable aqueous asphalt emulsion of claim 23 wherein in said process the emulsifier additionally comprises a nonionic surfactant.

25. A stable aqueous asphalt emulsion of claim 24 wherein in said process the nonionic surfactant is nonylphenol ethoxylate 100.

* * * * *